US006772810B1

(12) United States Patent
Bouchard et al.

(10) Patent No.: US 6,772,810 B1
(45) Date of Patent: Aug. 10, 2004

(54) CANTER CHIPPER HEAD AND KNIFE MOUNTING

(76) Inventors: Jean-Guy Y. Bouchard, 129 rue Principal, Macamic Quebec (CA), J0Z 2S0; Laurent J. Y. Trudel, 486 rue du Parc, La Sarre, Quebec (CA), J9Z 2E7; Joseph A. P. Robitaille, 54 avenue Gagnon, La Sarre Quebec (CA), J9Z 2P1

( * ) Notice: Subject to any disclaimer, the term of this patent is extended or adjusted under 35 U.S.C. 154(b) by 169 days.

(21) Appl. No.: 09/844,850

(22) Filed: Apr. 30, 2001

(51) Int. Cl.[7] ..... B27G 13/00; B27C 1/00

(52) U.S. Cl. ..... 144/220; 144/218; 144/241

(58) Field of Search ..... 144/3.1, 39, 162.1, 144/176, 218, 220, 230, 241; 407/46, 47, 79, 101

(56) References Cited

U.S. PATENT DOCUMENTS 5,271,442 A * 12/1993 Carpenter et al. ..... 144/220
5,439,039 A * 8/1995 Bradstreet, Sr. et al. .... 144/220
5,511,597 A * 4/1996 Shantie ..... 144/220
5,709,255 A * 1/1998 Toogood ..... 144/241 X
5,915,429 A * 6/1999 Pelletier et al. ..... 144/220 X
6,227,267 B1 * 5/2001 Michell et al. ..... 144/220

* cited by examiner

*Primary Examiner*—W. Donald Bray
(74) *Attorney, Agent, or Firm*—Stanley Johnson

(57) ABSTRACT

A canter chipper head having a base member machine shaped from a unitary block of metal and having a truncated conical outer face terminating in an end face and at least two chip discharge though passages. There are a pair of cutter units mounted in respective ones of a pair of recesses adjacent each chip discharge opening. The recesses and outline of the cutter units match and are machined to a close tolerance fit to positively locate the cutter units on the base member. Each cutter unit has a cutting knife clamped between a pair of plates and each plate is secured to the base member with a threaded stud.

9 Claims, 6 Drawing Sheets

CANTER CHIPPER HEAD AND KNIFE MOUNTING

FIELD OF INVENTION

This invention relates generally to canter chipper heads and more particularly to precision and secure mounting of the cutters and to refinements to the shape of the head.

BACKGROUND OF INVENTION

Chipper canters are know as are also canter heads with cutting knives removably mounted thereon and by way of example reference may be had to applicants U.S. Pat. No. 5,915,429 ISSUED Jun. 29, 1999 and entitled "COMPACT SMALL DIAMETER LOG SAWMILL".

Disclosed in applicants above patent (FIGS. 12–23) is a chipper canter head having chip discharge openings through a truncated conical portion of the head and a pair of cutting knives mounted adjacent each opening. The cutting edge of one knife extends along an edge of the opening in the conical portion of the head and the other knife cutting edge extends along an edge of the opening in an outer relatively flat end face of the head. The blades are removably mounted by studs passing through the respective blades and threaded into the head or by bolt and nut units.

Blades must be kept sharp and to do this they must be removed from the head. This can occur as often as each daily shift of operation and thus it is necessary the mounting means be readily accessible. In some prior art arrangements the mount securement is a bolt and nut with the nut accessible only from the rear face of the head. In such cases it is often necessary to remove the head from the canter drive shaft before attempting to remove the cutting blade.

The quality of the chips and the cant face is determined by not only by the sharpness of the cutting knives but also the precision of the head, the precision in positioning of the knives on the head and the rigidity of the head and blades thereon.

In an attempt to obtain some degree of precision in locating the cutting knives some are adjustably positionable and in this regard reference may be had to the following United States Patents:

- U.S. Pat. No. 5,709,255 issued Jan. 20, 1998 to W. Toogood
- U.S. Pat. No. 5,511,597 issued Apr. 30, 1996 to M. Shantie et al
- U.S. Pat. No. 5,439,039 issued Aug. 8, 1995 to J. Bradstreet Jr et al
- U.S. Pat. No. 5,2271,442 issued Dec. 21, 1993 to C. Carpenter These references also disclose a knife unit in which a double edge replaceable blade is clamped between a backing plate and a cover plate. This permits having only the blade made of high quality material such as tool steel or the like. The knife unit is removably mounted on a holder that bolts onto a hub.

While the knife unit is an improvement positioning can change from impact forces on the blades during use because of the many assembled components.

SUMMARY OF INVENTION

An object of the present invention is to provide a rugged precision mounting of cutting blades on a chipper canter head.

A further principal object of the present invention is to provide a knife mounting means that is readily accessible from the front face of the canter head.

A still further object of the present invention is to provide refinements to the shape of the one piece canter head.

In keeping with the forgoing there is provided in accordance with the present invention a chipper canter head comprising a base member machine shaped from a monolithic block of metal and having a truncated conical outer front face terminating in an outer end face, a rear face, at least two spaced apart chip discharge passages through said truncated conical portion and each having a continuous outline in each of said front and rear faces, each said passage extending into said outer end face, a pair of cutter units for each respective passage, each said cutter unit comprising a bottom plate, a top plate and a knife blade, said knife blade being clampingly engagable between said plates and having a longitudinally extending cutting edge projecting therefrom and means detachably mounting said cutter units on said canter head with the knife cutting edges disposed adjacent and along an edge of the opening to the discharge passage associated therewith, said mounting means comprising a first bolt means passing through said bottom plate detachably anchoring the same to said base member and a second bolt means passing through said top plate and said bottom plate anchoring the top plate to the base member and clampingly engaging the knife blade between said plates.

LIST OF DRAWINGS

The invention is illustrated, by way of example, in the accompanying drawing wherein.

PREFERRED EMBODIMENT

In the process of squaring logs chipper canter units operate in pairs chipping cants on opposite sides of the log as the log is propelled endwise along a predetermined path. One of the canter chipper heads rotates clockwise while the other in that pair rotates counter-clockwise. Shown in FIG.

Figure 1:
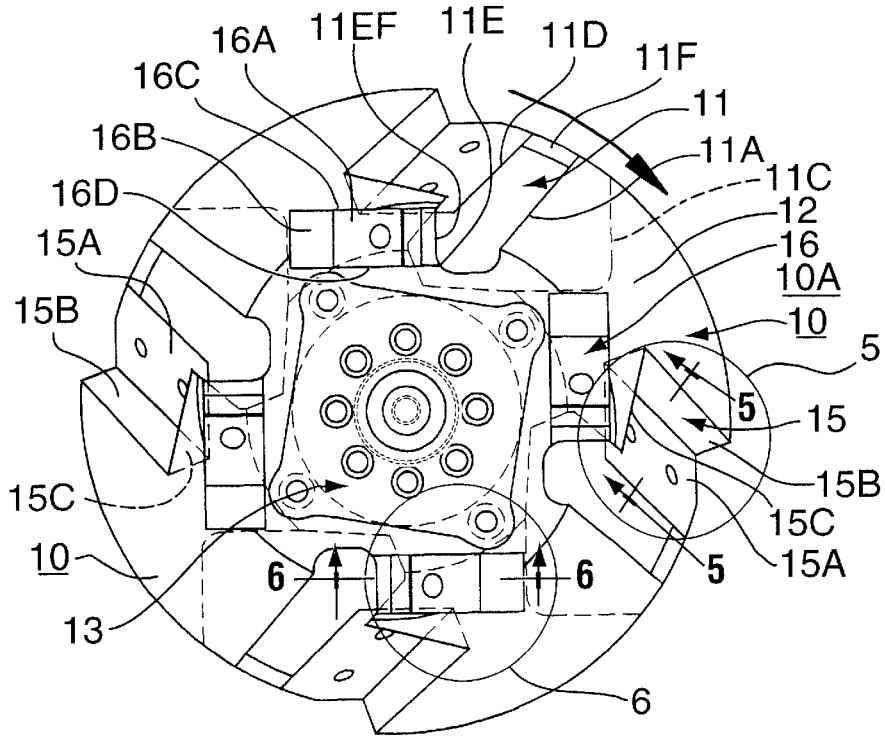
FIGS. 1 and 2 are front face views of a pair of base members of chipper canter heads, without the cutting knife units mounted thereon, and that are driven to rotate respectively clockwise and counter clockwise during use.
Figure 2:
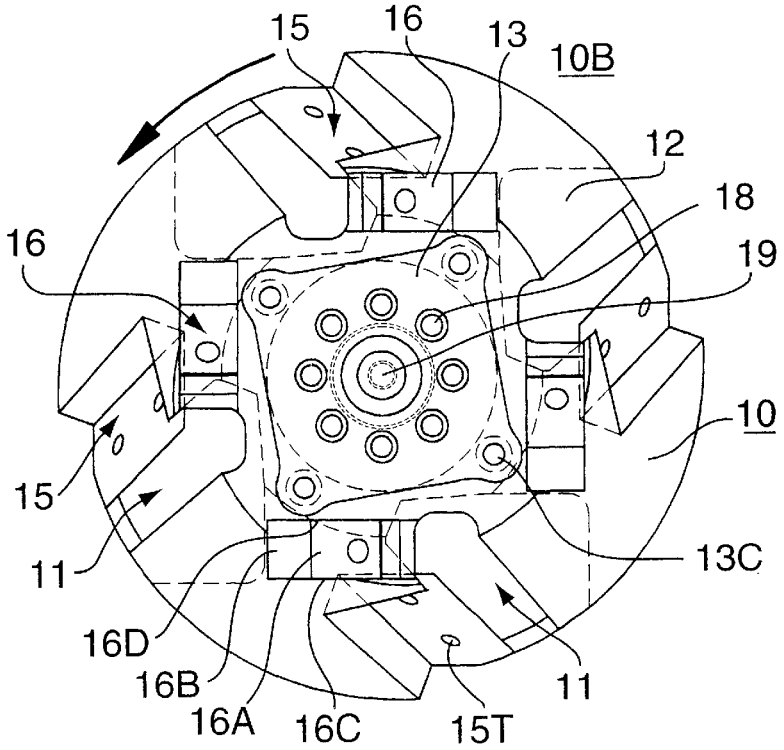
Figure 3:
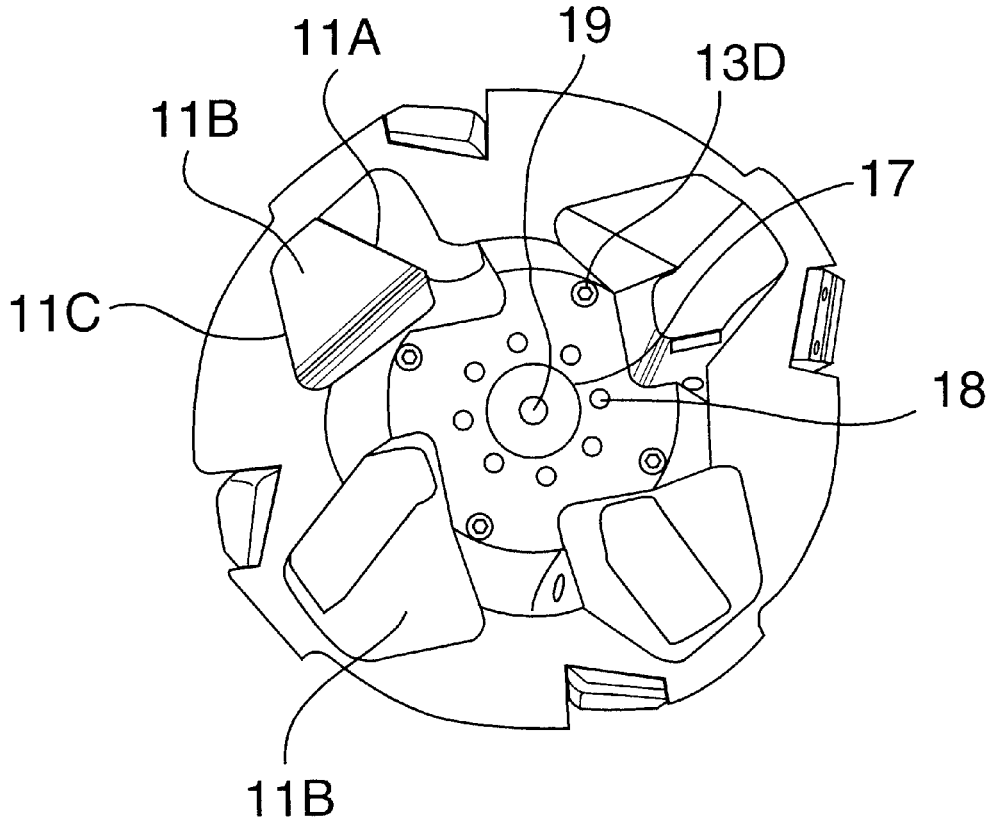
FIG. 3 is a rear view of FIG. 2.
Figure 4:
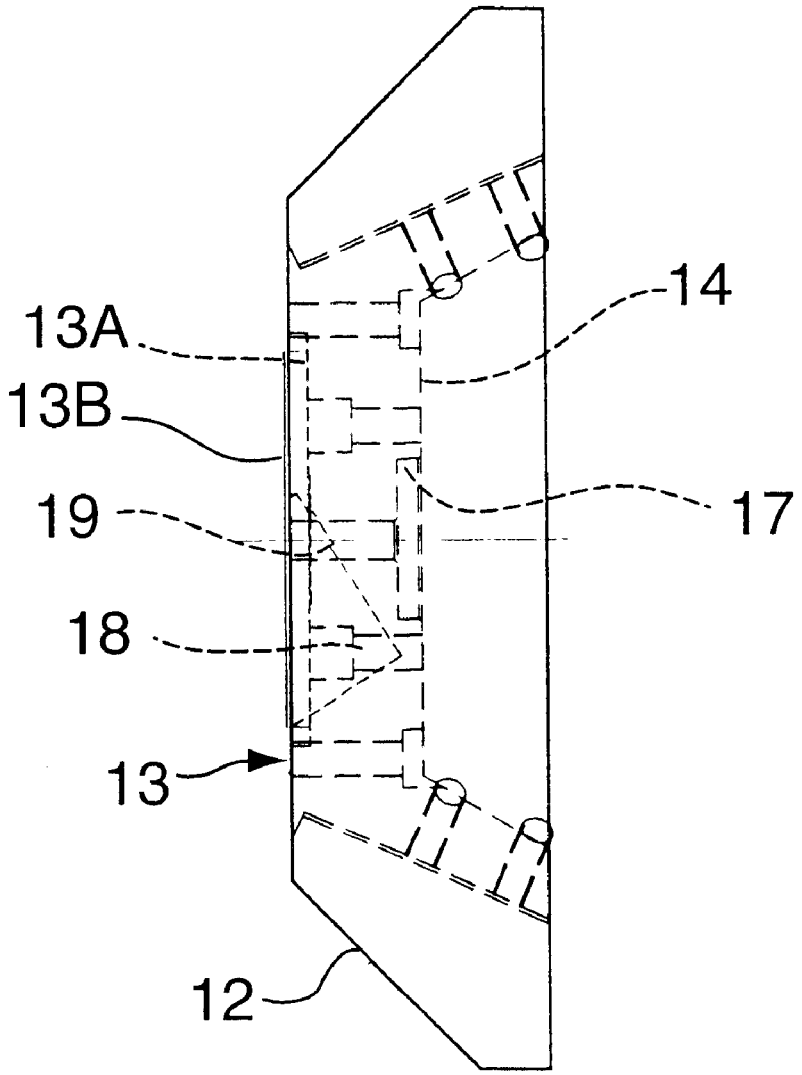
FIG. 4 is a side view of FIG. 1.
Figure 11:
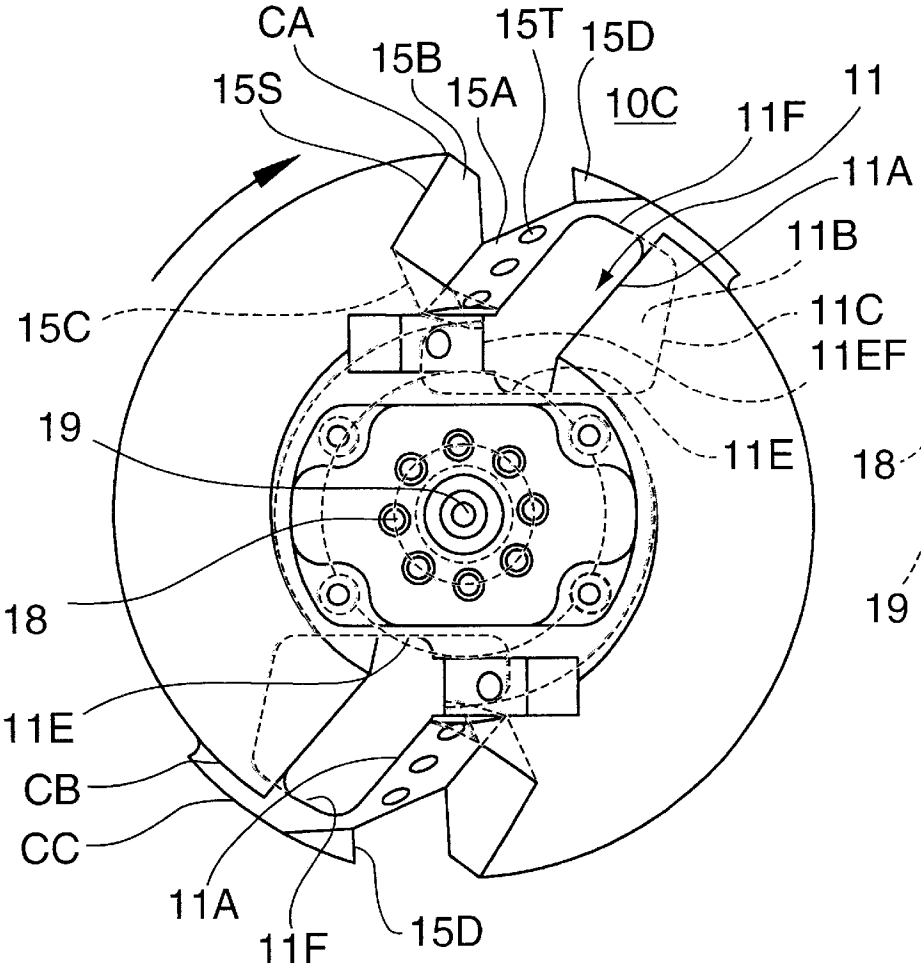
FIG. 11 is a front view of the canter chipper head base member with only two chip discharge passages and also illustrating a preferred recess for the principal knife unit.

1 is the base member 10A of a canter chipper head for clock-wise rotation and in FIG. 2 a base member 10B for counter-clockwise rotation with each having four chip cutting areas. The two base members are the same except for one being a mirror image of the other. In FIG. 11 is illustrated the base member 10C for clockwise rotation and having only two chip discharge passages and applicants preferred recess for the principal cutter.

The complete canter chipper head comprises a base member 10 with chip discharge passages 11 therethrough arranged in pairs(one diametrically opposite the other and equi-spaced for balance) and respective knife units 20 and 30 mounted on the base member adjacent the inlet to each respective chip discharge passage 11.

The base member is a monolithic block of metal precision machined to shape to include a front frusto-conical outer face 12 that terminates at an end face 13, a rear face 14 with a recess therein, one or more pairs of said chip discharge passages 11 and a pair of knife unit recesses 15 and 16 adjacent an edge at the inlet to each respective chip discharge passage. The recesses 15 are in the conical outer face 12 and the recesses 16 are in the end face 13. In the drawings FIG. 11 shows the preferred recess 15 and which will be described in detail hereinafter.

The inlet to each chip discharge passage, with reference to the direction of rotation, has a leading edge 11A along the conical surface with an inclined surface 11B that extends therefrom to an edge 11C in the rear face of the head. Opposite the leading edge 11A is a trailing edge 11D along which a cutting knife extends and there are respective inner and outer ends 11E, 11F with the outer end terminating in the outer rim. The surface 11B is inclined at a relatively small angle relative to the plane of the outer end face 13 so as to not imped the flow of chips or damage the same. The inner end 11E of the opening is in the end face 13 of the head providing an edge portion 11EF along which a second cutting knife extends.

The recess 15 for the knife unit 20 is located in the conical surface of the head and has a bottom face 15A, a rear edge face 15B and an inner edge face 15C. In the preferred embodiment illustrated in FIG. 11 there is an outer end edge face 15D at the outer rim of the head.

The recess 16 for the knife unit 30 is located in the end face of the head and has a bottom face 16A, an end face 16B and opposed edge faces 16C and 16D.

The cutter units 20 and 30 have respective bottom plates 21,31, top plates 22,32 and knife blades 23,33. Each knife blade has a pair of longitudinally extending cutting edges E, a top face TF and a back face BF with a centrally located groove G therein. The bottom plates 21,31 have respective upper surfaces 21A,31A with respective lips 21B, 31B that mate with the groove G in the knife blade associated therewith.

Figure 5:
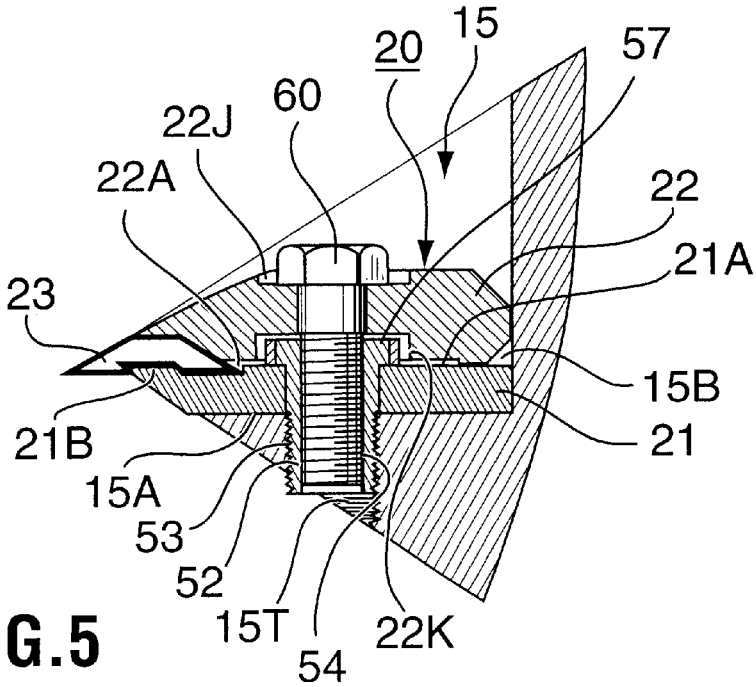
FIG. 5 is a sectional view of the encircled portion marked 5 in FIG. 1 but on a larger scale and taken essentially along line 5—5 but with the principal cutting knife unit mounted on the canter head base member.
Figure 7:
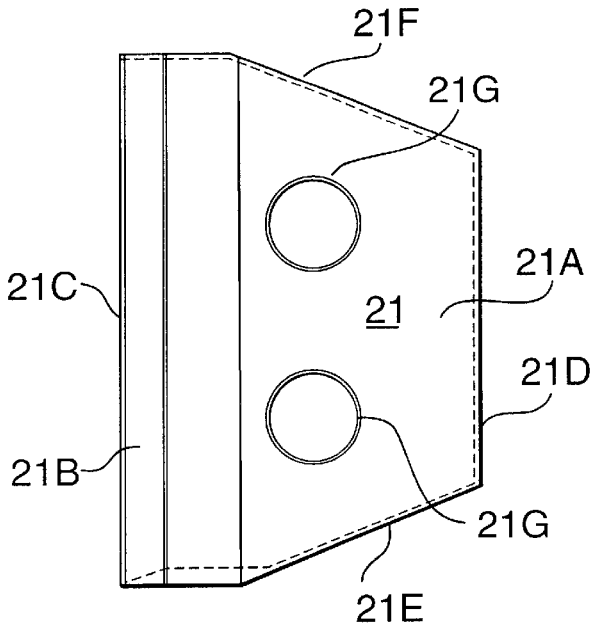
FIG. 7 is a plan view the bottom plate of the knife unit shown in cross-section in FIG. 5.
Figure 8:
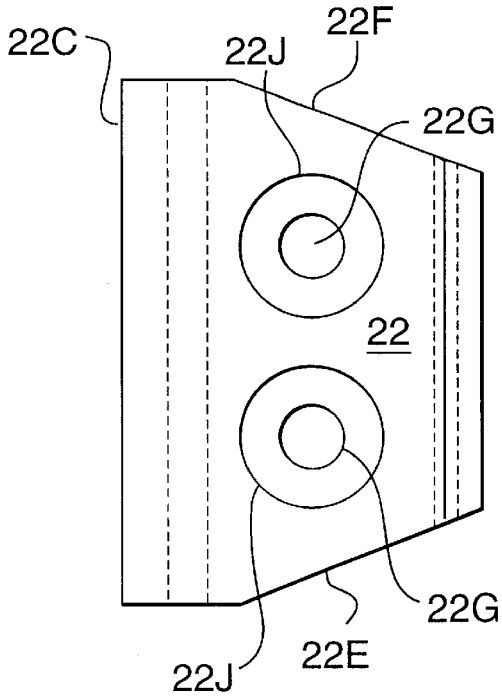
FIG. 8 is a plan view of the top plate of the knife unit shown in FIG. 5.

The bottom and top plates 21 and 22 of the knife unit 20 are shown in detail in FIGS. 5,7 and 8. The bottom plate 21 has a front edge 21C along which the lip 21B extends, a back edge 21D and respective opposite side edges 21E and 21F tapering inwardly toward the back edge 21D. There are two spaced apart mounting holes 21G through the plate.

The top plate 22, in outline shape, is the same as the bottom plate 21 and has a bottom face 22A, a front edge 22C, a back edge 22D and respective opposite side edges 22E and 22F. There are two mounting holes 22G through the plate and concentric with each are larger respective top and bottom counter-sinks 22J and 22K.

Figure 6:
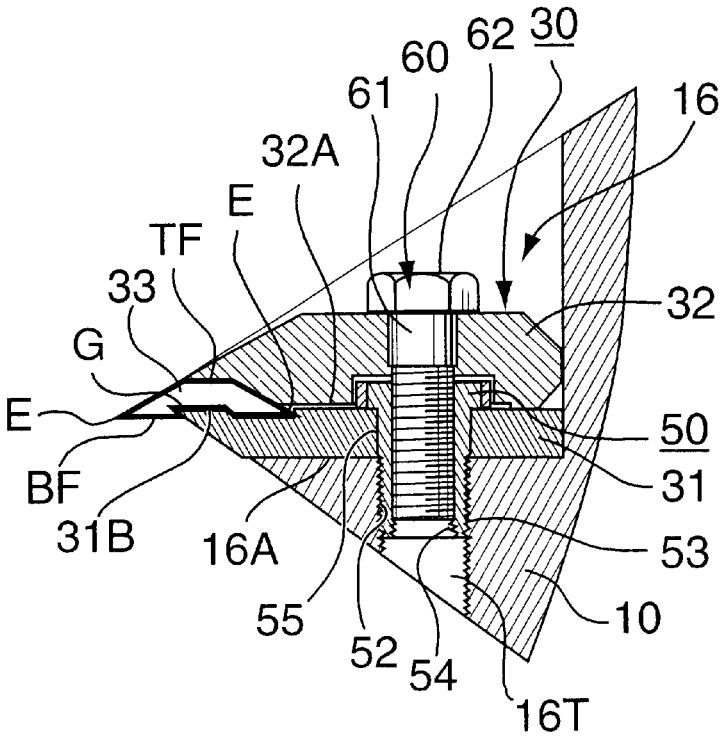
FIG. 6 is a sectional view of the encircled portion marked 6 FIG. 1 but on a larger scale and taken essentially along line 6—6 but with the secondary knife unit mounted on the canter head base member.
Figure 9:
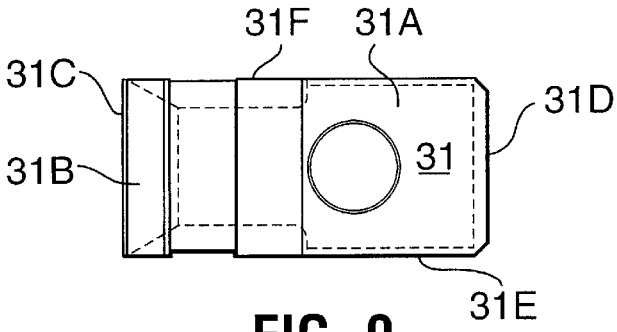
FIG. 9 is a plan view of the bottom plate of the knife unit shown in FIG. 6.
Figure 10:
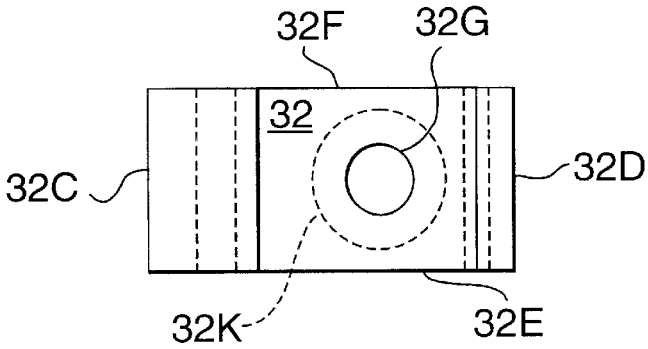
FIG. 10 is a plan view of the top plate of the knife unit shown in FIG. 6.
Figure 12:
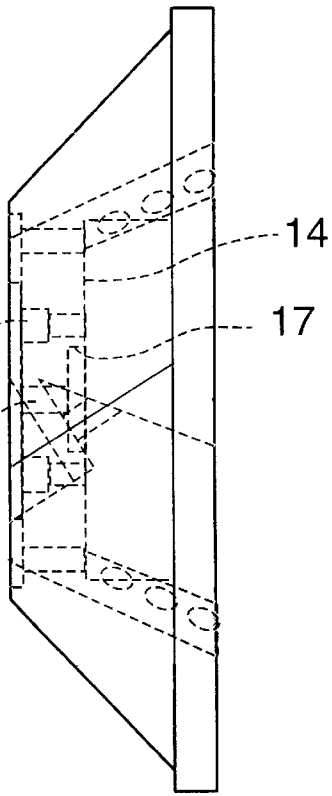
FIG. 12 is a side view of FIG. 11.

The bottom and top plates 31,32 of the knife unit 30 are shown in FIGS. 6,9 and 10. The bottom plate 31 has a front edge 31C along which the lip 31B extends, a back edge 31D and respective parallel side edges 31E and 31F.

The top plate 32, in outline shape, is the same as the bottom plate 31 and has a bottom face 32A, a front edge 32C,a back edge 32D and respective parallel side edges 32E and 32F. There is one mounting hole 32G through the plate and concentric therewith is a bottom counter-sink 32K.

The top and bottom plates and the respective recesses are of the same outline shape machined to a close fit tolerance so that the side and back edges of the plates abut the corresponding edges of the recess associated therewith. This provides fixed accurate positioning of the cutting edges of the knives.

The bottom plates 21,31 of the respective units 20 and 30 are detachably anchored to the base member by sleeve type studs 50. There are two studs 50 threaded into respective ones of a pair of threaded holes 15T in the base member anchoring the bottom plate 21 and one anchoring the bottom plate 31. With longer cutters as in FIG. 11 there are three threaded holes 15T anchoring studs. For anchoring the cutter units 30 there is a threaded hole 16T in the base member ln each of the recesses 16. Each stud 50 has a head 51 and a stem 52 that is externally and internally threaded as indicated respectively at 53 and 54. On the stem 52, between the head 51 and the external threads 53, there is a smooth surface portion 55 machined to a close tolerance fit with the hole associated therewith through the plate.

The top plates 22,32 are detachably anchored to the base member by studs 60 that thread into the internal threads in the stem of the sleeve studs 50. Each stud 60 has a smooth neck portion 61 adjacent the head 62 thereof machined for a close fit in the top plate through hole.

The head base member 10 has a central recess 17 in the rear face 13 for receiving a centering plug on a drive shaft of the canter. The flange on the drive shaft has threaded holes for receiving studs that pass through a respective one of 8 mounting holes 18. There's a center hole 19 that a centering stud passes through and threads into a threaded hole in the power driven shaft.

The end face 13 has a centrally located rectangular recess 13A that receives and end plate 13B secured to the base member 10 by four studs that pass through a respective one of four holes 13C and threaded into holes 13D.

The outer face of plate 13B tapers toward the center of rotation sloping at about 0.5 degrees with the center protruding beyond the lateral edges. The truncated conical surface tapers inwardly slightly, counter to the direction of rotation, from the leading edge 15S of a recess 15 to the leading edge 11A of the next chip passageway 11. With reference to FIG. 11 the radius to point CA is greater than the radius to point CB the difference being the distance from point CB to point CC.

We claim:

1. A canter chipper head comprising a base member machine shaped from a monolithic block of metal and having a truncated conical outer face terminating in an outer end face, an inner face with a central depression therein, at least two spaced apart chip discharge passages through said truncated conical portion and each having a continuous outline in each of said front and rear faces, each said opening extending into said outer end face, a pair of cutter units for each respective passage, each said cutter unit comprising a bottom plate, a top plate and a knife blade, said knife blade being clampingly engagable between said plates and having a longitudinally extending cutting edge projecting therefrom and means detachably mounting said cutter units on said base member with the knife cutting edges disposed adjacent and along an edge of the opening to the discharge passage associated therewith, said mounting means comprising a first bolt means passing through said bottom plate into said base member and a second bolt means passing through said top and bottom plate into said base member, said first bolt means anchoring the bottom plate to the base member and second bolt means anchoring the top plate to the base member and clampingly engaging the knife blade between said plates.

2. A canter chipper head as defined in claim 1 including recesses in said base member for each of the respective cutter units.

3. A canter chipper head as defined in claim 2 wherein the recesses and the bottom plates of the cutter units associated therewith correspond in outline shape and in close fit relation.

4. A canter chipper head as defined in claim 3 wherein the knife mounting bottom plates have a rear edge, remote from the cutting edge of the knife associated therewith, and a pair of opposite side edges and wherein said edges are disposed in abutting relation with edge faces in the respective recesses.

5. A canter chipper head comprising a base member machined to shape from a unitary metal block and having a truncated conical front face terminating in an outer end face, at least two spaced apart chip discharge openings through said truncated portion and extending into said outer end face, a pair of cutting units detachably mounted in respective ones of a pair of recesses adjacent an edge of each discharge opening, one of said pair of cutter units being located in the conical portion and the other in said outer end face, each said cutter unit comprising a bottom plate, a front plate and a replaceable knife located between said plates and having a cutting edge projecting therefrom and means detachably anchoring said knife units to said base member comprising a first stud extending through said bottom plate and threaded into said base member detachably anchoring the bottom plate to the base member and a second stud passing through both of said plates into the base member attaching the top plate to the base member and clamping the knife between said plates.

6. A canter chipper head as defined in claim 5 wherein said first stud comprises an internally and externally threaded stem projecting from a head which engages an upper face of said bottom member and wherein said second stud is threaded into said internal threads.

7. A canter chipper head as defined in claim 5 wherein said first and second studs are concentric.

8. A canter chipper head as defined in claim 5 wherein said bottom plates of the cutter units have edges engaging side walls of the recess associated therewith at three spaced part positions opposite the cutting edge of the knife associated therewith thereby positively locating the cutter unit in the recess therefore in the base member.

9. A canter chipper head as defined in claim 1 wherein said frusto-conical surface tapers inwardly in a direction counter to the direction of rotation of the head from adjacent the trailing end of one chip passage to adjacent the leading end of the next adjacent chip passage.

* * * * *